United States Patent [19]

Finlay

[11] 4,180,343

[45] Dec. 25, 1979

[54] GRATING FASTENER

[76] Inventor: Glenn Finlay, P.O. Box 306, Daingerfield, Tex. 75638

[21] Appl. No.: 924,244

[22] Filed: Jul. 13, 1978

[51] Int. Cl.[2] ..... F16B 2/12

[52] U.S. Cl. ..... 403/24; 403/387; 52/507

[58] Field of Search ..... 403/387, 400, 24; 52/507, 581

[56] References Cited

U.S. PATENT DOCUMENTS

| | | | |
|---|---|---|---|
| 1,707,533 | 4/1929 | Nagin | 52/581 |
| 1,729,694 | 10/1929 | Von Hagel | 403/387 |
| 2,467,877 | 4/1949 | Barry | 52/507 |
| 3,367,078 | 2/1968 | Thompson, Jr. | 52/507 |
| 3,456,412 | 7/1969 | Decombas | 403/400 X |

FOREIGN PATENT DOCUMENTS

| | | | |
|---|---|---|---|
| 1091473 | 10/1954 | France | 403/400 |
| 931134 | 7/1963 | United Kingdom | 403/387 |

*Primary Examiner*—Andrew V. Kundrat

*Attorney, Agent, or Firm*—Richards, Harris & Medlock

[57] ABSTRACT

The specification discloses an improved fastener particularly designed for anchoring sections of grating to an underlying support. The fastener includes a saddle clip for engagement with the top edges of elements comprising the grating. A leg is secured at one end to the saddle clip and extends downwardly therefrom. The leg slidably carries a foot which extends beneath the support for the grating. The foot is threadedly coupled to the saddle clip for actuation into engagement with the support to removably secure the grating in place.

10 Claims, 6 Drawing Figures

GRATING FASTENER

BACKGROUND AND SUMMARY OF THE INVENTION

The present invention relates generally to a releasable fastener. More particularly, this invention concerns an improved fastener assembly for anchoring sections of grating.

Sections of grating or grates are often used in construction projects as walkways or floors. For example, a large number of gratings are typically utilized in the fabrication of an industrial structure. Each grating constitutes a section of flooring which must be positioned in place and then secured. Traditionally, each section of grating has been either bolted or welded in place. Either of these fastening techniques is time consuming and therefore expensive in terms of labor when a large number of gratings are involved, such as in an industrial structure. In addition, the use of bolts requires that holes be drilled, each of which becomes a weak spot for rust and other corrosion damage. In some situations, sections of grating must be removable, whereby a welded connection is unsatisfactory. There is thus a need for an improved fastener for releasably anchoring sections of grating to an underlying support without drilling holes or welding. The prior art includes some grating fasteners for removably securing a grating to a support. However, the fasteners of the prior art are neither quickly nor easily installed and suffer from other disadvantages.

The present invention comprises a grating fastener which overcomes the foregoing and other problems associated with the prior art. In accordance with the broader aspects of the invention, there is provided an improved fastener assembly for releasably securing grating to an underlying support. Holes, which invite corrosion, are not required to be drilled in either the grating or the supporting structure. The fastener of the present invention comprises an assembled unit of inexpensive construction which is quickly installed from a position above the grating. The fastener of the present invention is installed without requiring the installer to reach around or manipulate any special tools extending through and beneath the grating. The invention thus comprises an improved grating fastener which enables quick installation while affording greater safety to the installers as well as to equipment and personnel located below.

In accordance with more specific aspects of the invention, an improved grating fastener includes a saddle clip for bridging two adjacent bearing bars of the grating. Preferably, the outer edges of the saddle clip include at least one pair of opposing cutouts for accommodating cross bars in the grating, which might otherwise interfere with location of the fastener. A leg is connected at one end to the saddle clip and extends downwardly through the grating. A foot is slidably carried on the leg for linear translation and extends outwardly beneath the underlying support for the grating. The bottom end of the leg is preferably configured so that the foot is captive thereon. In accordance with the preferred construction, the leg comprises a reinforced section to resist bending. The foot is selectively actuated into engagement with the underlying grating support by a threaded member interconnecting the saddle clip and the foot.

DESCRIPTION OF THE DRAWINGS

A more complete understanding of the invention can be had by reference to the following Detailed Description in conjunction with the accompanying Drawings, wherein.

DETAILED DESCRIPTION

Figure 1:
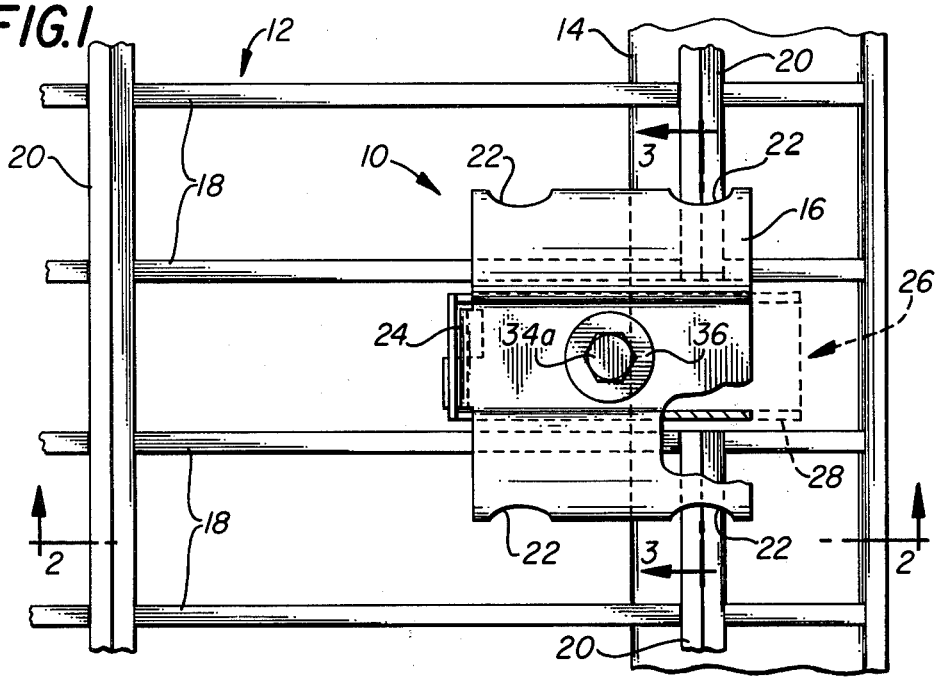
FIG. 1 is a partial plan view of a grating anchored to an underlying support with a fastener incorporating the invention.

Referring now to the Drawings, wherein like reference numerals designate like or corresponding parts throughout the views, and particularly referring to FIG. 1, there is shown an improved fastener 10 incorporating the invention. Fastener 10 is particularly suited for releasably securing a grate or section of grating 12 to an underlying support 14. Fastener 10 is utilized without any holes being drilled in either grating 12 or support 14. Fastener 10 is completely installed from a position above grating 12 without special tools or manipulation to afford greater safety to the installer as well as to equipment and personnel located below. Preferably, fastener 10 is constructed of galvanized metal to resist corrosion.

Fastener 10 includes a saddle clip 16 for engagement with grating 12. Grating 12 comprises a plurality of parallel bearing bars 18 interconnected by cross bars 20. Saddle clip 16 includes a flat central portion and raised arcuate outer portions and is adapted to bridge two adjacent bars 18 of grating 12. In accordance with the preferred construction, the outside edges of the arcuate portions of saddle clip 16 include cutouts 22 for accommodating cross bars 20, if any, which might otherwise interfere with proper positioning of the fastener 10 between grating 12 and support 14. It will thus be appreciated that saddle clip 16 occupies a recessed position in grating 12 and does not cause a trip hazard.

Figure 2:
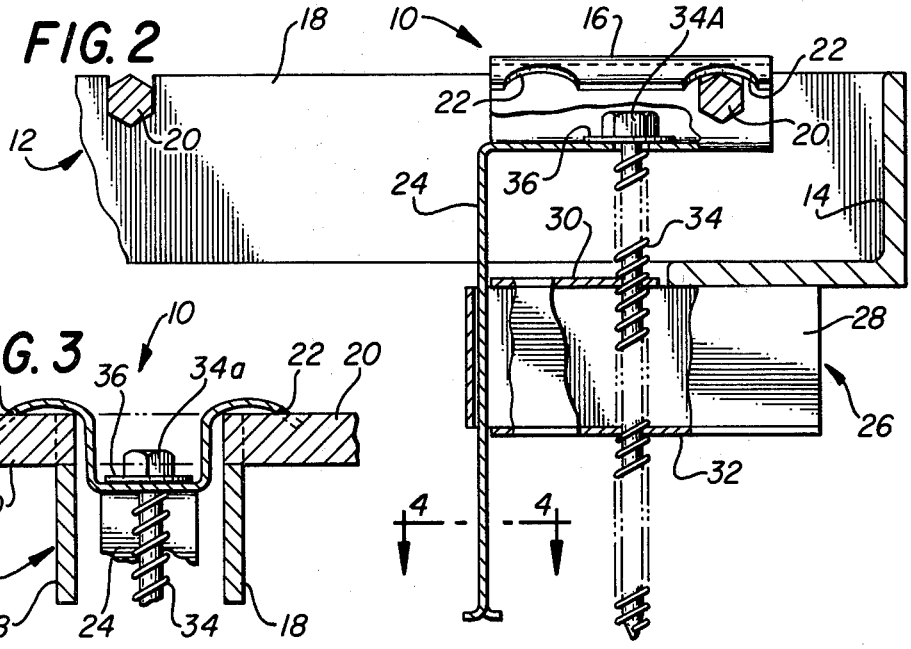
FIG. 2 is a partial vertical section view taken along lines 2—2 of FIG. 1 in the direction of the arrows.
Figure 3:
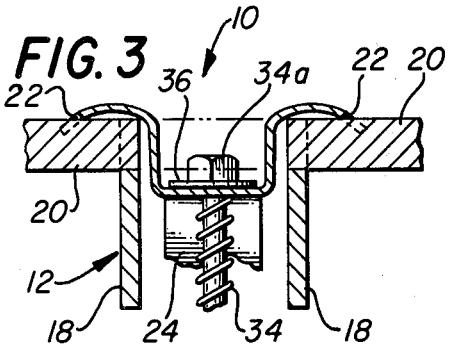
FIG. 3 is a partial vertical section view taken along lines 3—3 of FIG. 1 in the direction of the arrows.
Figure 4:
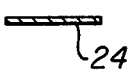
FIG. 4 is a section view taken along lines 4—4 of FIG. 2 in the direction of the arrows.

Referring to FIG. 2, leg 24 is attached at one end to saddle clip 16 and extends between bars 18 downwardly through grating 12. If desired, saddle clip 16 and leg 24 can be constructed as an integral component, such as by means of a stamping process. A cross section of leg 24 is shown in FIG. 4. It will thus be apparent that leg 24 extends downwardly from saddle clip 16 to a point below support 14. For purposes of illustration, support 14 is shown as an angle iron; however, it will be understood that fastener 10 can be utilized with any suitable structure having a flanged portion for supporting grating 12.

A foot 26 is slidably carried on leg 24 of fastener 10. Foot 26 comprises a pair of side plates 28 which extend around leg 24. Plates 30 and 32 are provided across the top and bottom edges, respectively, of side plates 28 to define a guideway for leg 24. A threaded member 34 interconnects saddle clip 16 and foot 26. If desired, threaded member 34 can comprise a bolt, lag screw or the like having its head 34a extending through the central flat portion of saddle clip 16. If desired, a washer 36 can be provided between the head **34*a* of threaded member 34 and saddle clip 16. In accordance with the preferred construction, member 34 is threadedly engaged by coaxial apertures provided in both upper and lower plates 30 and 32 of foot 26 so that the foot translates along leg 24** without binding.

It will thus be apparent that rotation of member 34 causes foot 26 to translate along leg 24 into engagement with support 14 to anchor grating 12 thereto. Rotation of member 34 in the opposite position causes foot 26 to move out of engagement with support 14, allowing removal of fastener 10 and grating 12. Actuation of member 34 can be accomplished manually or with a power tool from a position above grating 12.

Preferably, the lower end of leg 24 is turned outwardly as is best shown in FIG. 2, whereby foot 26 is captive thereon. Thus, foot 26 will not drop away should it become disengaged from threaded member 34. In addition, the configuration of leg 24 prevents rotation of foot 26 out of aligned relationship with clip 16. Fastener 10 is most advantageously used when saddle clip 16, leg 24, foot 26 and member 34 are assembled together. When so assembled, fastener 10 is simply dropped into grating 12, slid into position so that foot 26 extends beneath support 14, and then secured by rotating member 34. However, it will be understood that threaded member 34 can be inserted after placement of a fastener comprising clip 16, leg 24 and foot 26 without requiring alignment between the foot and the clip.

Figure 5:
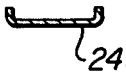
FIGS. 5 and 6 are sectional views of alternate configurations of the leg of the invention.
Figure 6:
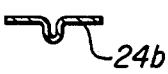

Referring now to FIGS. 5 and 6, there are shown two alternate configurations for leg 24. FIG. 5 illustrates a channel section 24*a*, while FIG. 6 illustrates a ribbed section 24*b*. Under some circumstances, it may be desirable to stiffen leg 24 against bending by utilizing a reinforced section such as 24*a* or 24*b*. Sections 24*a* and 24*b* are shown for purposes of illustration, it being understood that leg 24 can comprise any suitable reinforced configuration.

From the foregoing, it will be understood that the present invention comprises a grating fastener incorporating numerous advantages over the prior art. Use of the present invention enables sections of grating to be removably anchored in place in less time and with greater safety to the installers as well as any personnel working below. The present invention comprises a fastener assembly which is installed and completely manipulated without special tools from a position on top of the grating. Other advantages derived from the use of the present invention will readily suggest themselves to those skilled in the art.

Although particular embodiments of the invention have been illustrated in the accompanying Drawings and described in the foregoing Detailed Description, it will be understood that the application is not limited to the embodiments disclosed, but is intended to embrace any alternatives, modifications, and rearrangements and/or substitutions of parts or elements as fall within the spirit and scope of the invention.

What is claimed is:

1. For use in combination with an externally threaded member, a fastener assembly for securing grating to an underlying support, which comprises:

clip means for engaging the top surface of the grating;

said clip means having an aperture for receiving one end of the externally threaded member;

leg means connected at one end to the clip means and spaced from said aperture and and extending downwardly therefrom through the grating; and foot means extending outwardly from the leg means and captively supported on by said leg means for slidable linear movement therealong between engaging and nonengaging positions relative to the support;

said foot means having at least one aperture therein coaxial with the aperture in the clip means for threadedly receiving the other end of the externally threaded member.

2. The fastener of claim 1, wherein the clip means comprises a saddle clip having a substantially flat central portion for positioning between adjacent elements of the grating and raised arcuate outer portions for positioning over the top edges of the adjacent elements of the grating.

3. The fastener of claim 1 wherein the clip means and the leg means are constructed from a single piece of material.

4. For use in combination with an externally threaded member, a fastener assembly for securing grating to an underlying support, which comprises:

clip means for engaging the top surface of the grating;

said clip means having an aperture for receiving one end of the externally threaded member;

leg means connected at one end to the clip means and extending downwardly therefrom through the grating; and foot means extending outwardly from the leg means and slidably supported on said leg means for linear movement relative to the clip means; P1 said foot means having at least one aperture therein coaxial with the aperture in the clip means for threadedly receiving the other end of the externally threaded member;

said clip means comprising a saddle clip having a substantially flat central portion for positioning between adjacent elements of the grating and raised arcuate outer portions for positioning over the top edges of the adjacent elements of the grating;

said saddle clip including at least one pair of opposite cutouts in the arcuate outer portions for accommodating cross elements of the grating.

5. For use in combination with an externally threaded member, a fastener assembly for securing grating to an underlying support, which comprises:

clip means for engaging the top surface of the grating;

said clip means having an aperture for receiving one end of the externally threaded member;

leg means connected at one end to the clip means and extending downwardly therefrom through the grating; and foot means extending outwardly from the leg means and slidably supported on said leg means for linear movement relative to the clip means;

at least a portion of the bottom end of the leg means being turned outwardly so that the foot means is slidably captive thereon;

said foot means having at least one aperture therein coaxial with the aperture in the clip means for threadedly receiving the other end of the externally threaded member.

6. For use in combination with an externally threaded member, a fastener assembly for securing grating to an underlying support, which comprises:

clip means for engaging the top surface of the grating;

said clip means having an aperture for receiving one end of the externally threaded member;

leg means connected at one end to the clip means and extending downwardly therefrom through the grating; and foot means extending outwardly from the leg means and slidably supported on said leg means for linear movement relative to the clip means;

said foot means having at least one aperture therein coaxial with the aperture in the clip means for threadedly receiving the other end of the externally threaded member;

said foot means comprising:

a pair of spaced apart sidewalls;

an end wall connecting the ends of said sidewalls;

a top wall connecting at least a portion of the top edges of said sidewalls; and a bottom wall connecting at least a portion of the bottom edges of said sidewalls;

said top and bottom walls having coaxial apertures therein for threadedly receiving the externally threaded member.

7. A fastener assembly for anchoring a grating formed of bearing bars and cross bars to an underlying support, which comprises:

a saddle clip having two arcuate outer portions for engagement with the top edges of adjacent grating bearing bars, and a recessed substantially flat central portion positioned therebetween;

a straight leg secured at one end to said saddle clip and extending downwardly therefrom through the grating;

foot means extending outwardly from and slidably supported on said leg means for translation relative to the saddle clip;

said leg including a bottom end portion turned outwardly so that the foot means is captive on said leg; and an externally threaded member interconnecting the saddle clip and the foot means and operative to actuate said foot means into and out of engagement with the underlying support.

8. The fastener of claim 7 wherein the outer arcuate portions of the saddle clip include at least one pair of opposite cutouts for accommodating the cross bars of the grating.

9. The fastener of claim 7 wherein the leg comprises a channel section for increased bending resistance.

10. The fastener of claim 7 wherein the leg comprises a ribbed section for increased bending resistance.

* * * * *

UNITED STATES PATENT AND TRADEMARK OFFICE

CERTIFICATE OF CORRECTION

PATENT NO. : 4,180,343

DATED : December 25, 1979

INVENTOR(S) : Glenn Finlay

It is certified that error appears in the above-identified patent and that said Letters Patent are hereby corrected as shown below:

Column 4, line 30 (Claim 4),line 13 of Amended Claim 4, delete "Pl" and begin new paragraph "said foot . . . member;" should be new paragraph.

Signed and Sealed this

*Twenty-fifth* Day of *March 1980*

[SEAL]

*Attest:*

SIDNEY A. DIAMOND

*Attesting Officer*

*Commissioner of Patents and Trademarks*